US005839981A

United States Patent [19]

Rudell et al.

[11] Patent Number: 5,839,981

[45] Date of Patent: Nov. 24, 1998

[54] PROJECTILE ACTIVATED WATER RELEASE GAME

[75] Inventors: Elliot Rudell, Torrance; Joseph Cernansky, Palos Verdes Estates; George Foster, Long Beach, all of Calif.

[73] Assignee: Elliot A. Rudell, Torrance, Calif.

[21] Appl. No.: 922,158

[22] Filed: Sep. 2, 1997

[51] Int. Cl.[6] ..... A63B 63/08

[52] U.S. Cl. ..... 473/480; 273/384

[58] Field of Search ..... 273/317, 349, 273/384; 473/479, 480

[56] References Cited

U.S. PATENT DOCUMENTS

| | | | |
|---|---|---|---|
| D. 334,044 | 3/1993 | Lopatin | D21/240 |
| 2,192,430 | 3/1940 | Branner | 273/480 X |
| 4,093,228 | 6/1978 | Pierce | 273/384 |
| 4,702,480 | 10/1987 | Popeski et al | 273/384 |
| 4,813,680 | 3/1989 | Rudell et al. . | |
| 4,881,733 | 11/1989 | Rehkemper et al. . | |
| 4,890,838 | 1/1990 | Rudell et al. . | |
| 4,991,847 | 2/1991 | Rudell et al. . | |
| 5,256,099 | 10/1993 | Rudell et al. . | |
| 5,263,714 | 11/1993 | Rudell et al. . | |
| 5,390,913 | 2/1995 | Kepler | 273/384 X |
| 5,482,292 | 1/1996 | Stone | 273/384 |
| 5,661,460 | 8/1997 | Rudell . | |

*Primary Examiner*—William H. Grieb
*Attorney, Agent, or Firm*—Blakely Sokoloff Taylor & Zafman

[57] ABSTRACT

A toy that releases a fluid onto a player when another player successfully projects a projectile onto a target. The toy may include a basketball hoop and a container that is filled with a fluid. The hoop is coupled to the container by a release mechanism and a trigger. The container may be elevated above a player by a post. The release mechanism is switched to a released state so that the fluid is released onto the player when the projectile is thrown through the basketball hoop and engages the trigger a predetermined number of times.

3 Claims, 3 Drawing Sheets

PROJECTILE ACTIVATED WATER RELEASE GAME

BACKGROUND OF THE INVENTION

1. Field of the Invention

The present invention relates to a toy basketball game that releases water onto a player when another player successfully makes one or more baskets.

2. Background Information

Water toys, ranging from water guns to water slides, have become increasingly popular over the years. Kids enjoy the dual nature of becoming wet while operating the toys.

U.S. Pat. Nos. 4,890,838 and 4,991,847 issued to Rudell et al, disclose water novelties sold by Lewis Galoob Toys under the trademark SPLASH OUT. The Rudell toy includes a two-piece ball that is molded with slots in an outer housing. A water balloon is loaded into the ball and a mechanical timer is set. The players throw the ball back and forth while the timer is winding down. When the timer runs out, a spring loaded pin is activated to puncture the balloon and release water onto the player holding the ball.

U.S. Pat. No. 4,881,733 issued to Rehkemper et al., discloses another water release toy ball. The Rehkemper device includes a plastic housing that is attached to a water balloon. The housing also has means for puncturing the balloon at random or predetermined time intervals. The balloon and housing are tossed between two or more players until the balloon is ruptured and water is released onto one of the players.

U.S. Pat. No. 4,813,680 issued to Rudell et al/, discloses a toy that was sold by Mattel, Inc. under the trademark WET HEAD. WET HEAD comprises a hat-shaped housing that has a reservoir of water and a plurality of detachable sticks extending from the side of the housing. One of the sticks functions as a valve for the reservoir, such that water is released from the housing when the selected stick is pulled out of the device. The game is played by filling the reservoir, donning the hat and then pulling out one of the sticks. The hat is passed around to different players until someone pulls out the stick that releases the water. The water falls onto the player's head, thereby penalizing the player for pulling the wrong stick.

U.S. Pat. No. 5,256,099 issued to Rudell et al., discloses a toy water sword which releases water when a tip of the sword is depressed.

U.S. Pat. No. 5,263,714 issued to Rudell et al., discloses a toy water release game that is shaped as an octopus. The toy octopus has a plurality of legs which can be depressed by the players of the game. The toy has an internal hidden trigger mechanism which releases water when one of the legs is depressed by a player. The players do not know which one of the legs will release the water. The toy thereby provides a certain amount of suspense each time a player depresses a leg.

U.S. Pat. No. 5,611,460 issued to Rudell discloses a shield which contains a water spray mechanism. The shield can both squirt another player and block a "shot" of the opposing player.

SUMMARY OF THE INVENTION

A toy which releases a fluid when a player successfully projects a projectile onto a target. The toy includes a sensor that is coupled to a release mechanism. The release mechanism can be switched from a secured state to a released state. The release mechanism is coupled to a container which contains a fluid. The release mechanism switches to the released state and allows the container to release the fluid when the projectile is projected onto the sensor.

DETAILED DESCRIPTION OF THE INVENTION

In one embodiment, the present invention is a toy that releases a fluid onto a player when another player successfully projects a projectile onto a target. The toy may include a basketball hoop and a container that is filled with a fluid. The hoop is coupled to the container by a release mechanism and a trigger. The container may be elevated above a player by a post. The release mechanism is switched to a released state so that the fluid is released onto the player when the projectile is thrown through the basketball hoop and engages the trigger a predetermined number of times. The predetermined number of times may be one.

Figure 1:
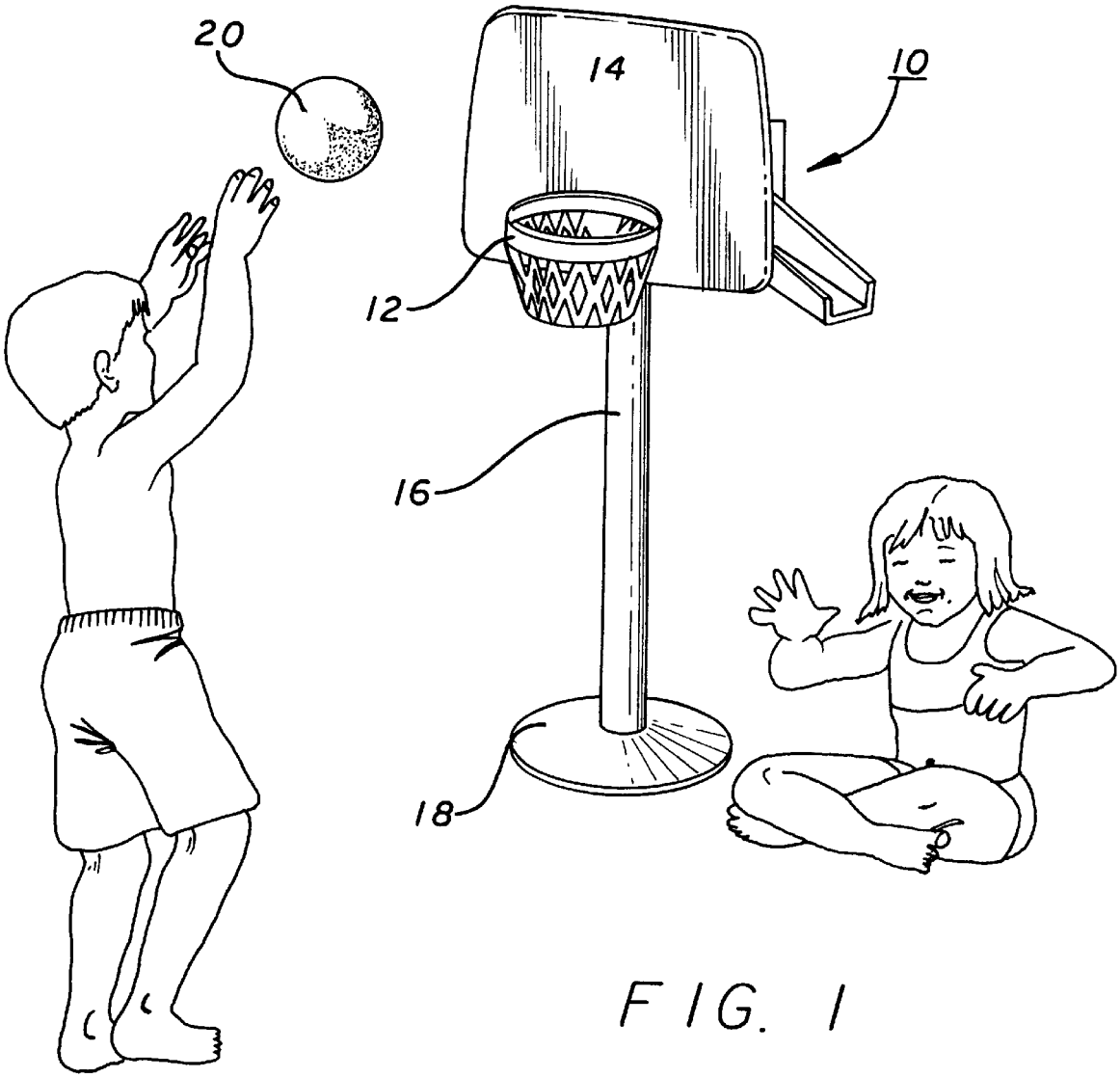
FIG. 1 is a front perspective view showing a toy of the present invention.
Figure 2:
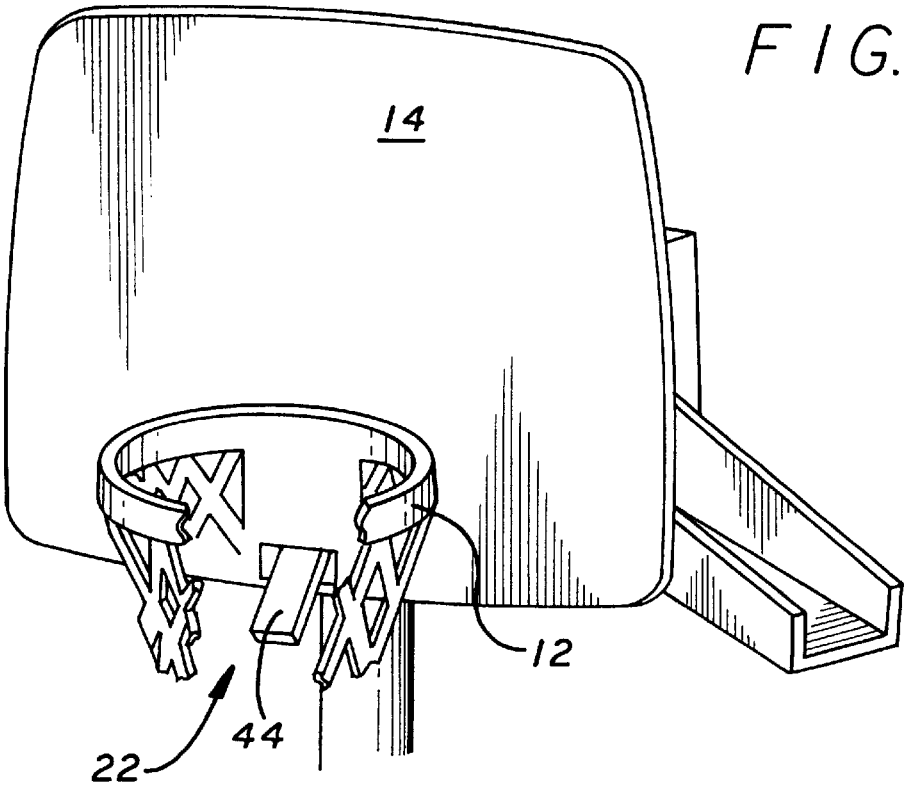
FIG. 2 is a front enlarged perspective view of the toy.
Figure 3:
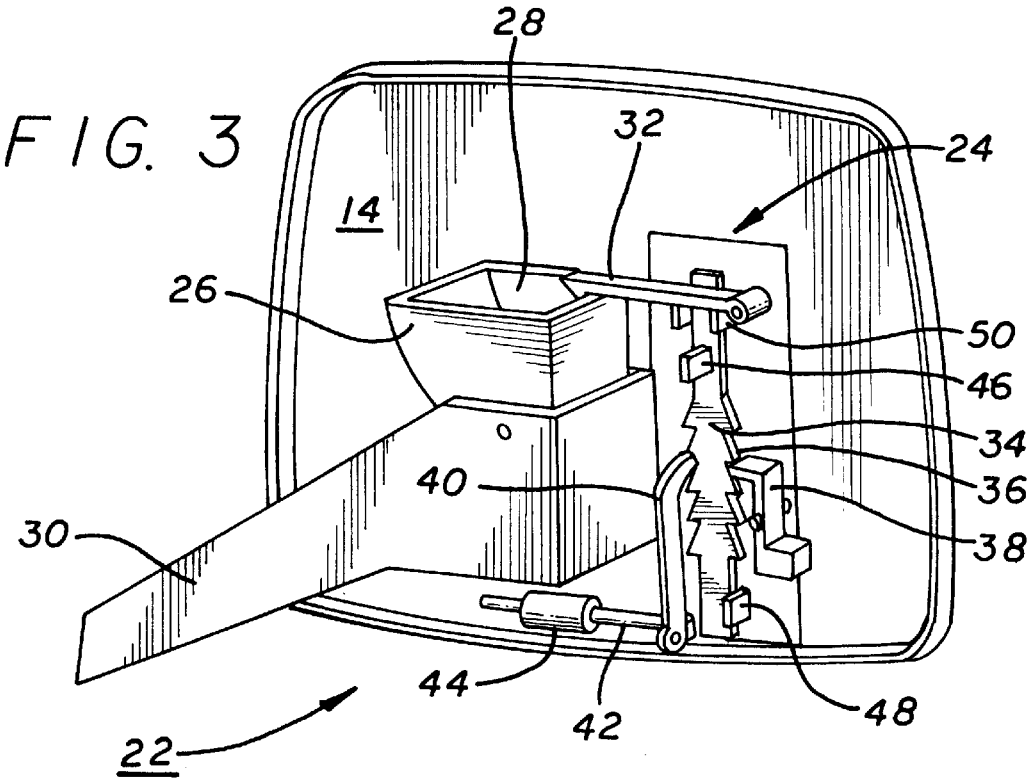
FIG. 3 is a rear perspective view of the toy.

Referring to the drawings more particularly by reference numbers, FIGS. 1–3 show a toy 10 of the present invention. In one embodiment, the toy 10 includes a basketball hoop 12 that is attached to a backboard 14. The backboard 14 and hoop 12 are elevated by a pole 16. The pole 16 can be attached to a base 18. A projectile 20 such as a basketball is projected toward the basketball hoop.

As shown in FIG. 2, adjacent to the hoop 12 is a sensor 22. The sensor 22 may be a trigger that is activated each time a player successfully throws the projectile 20 through the basketball hoop 12. As shown in FIGS. 2 and 3, the sensor 22 is coupled to a release mechanism 24 that can be switched from an engaged state to a released state. The release mechanism 24 is coupled to a container 26 which contains a fluid 28. The release mechanism 24 normally engages the container 26 and holds the fluid. The release mechanism 24 is disengaged from the container 26 when switched to the released state.

Figure 4:
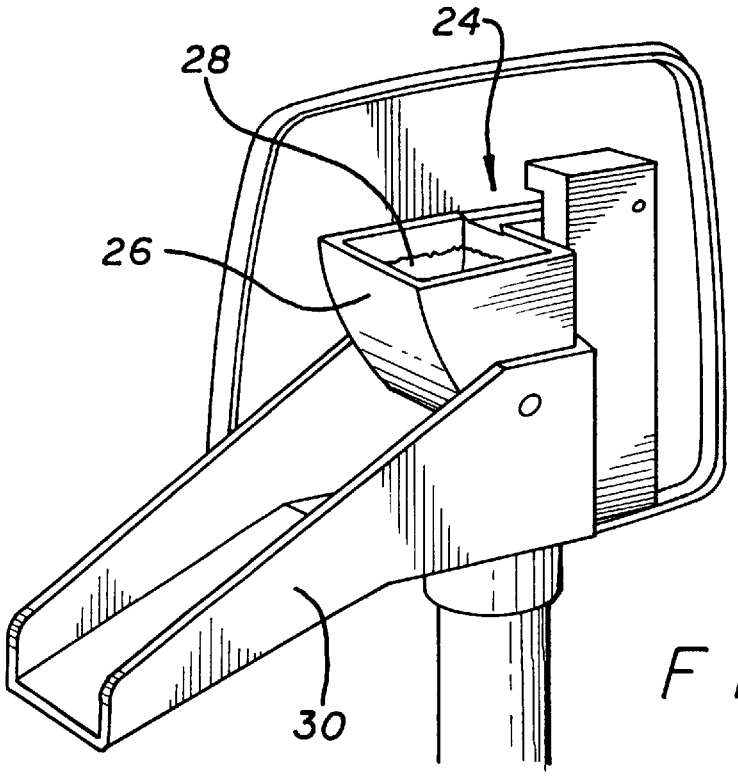
FIG. 4 is a rear perspective view showing the toy is a secure state.
Figure 5:
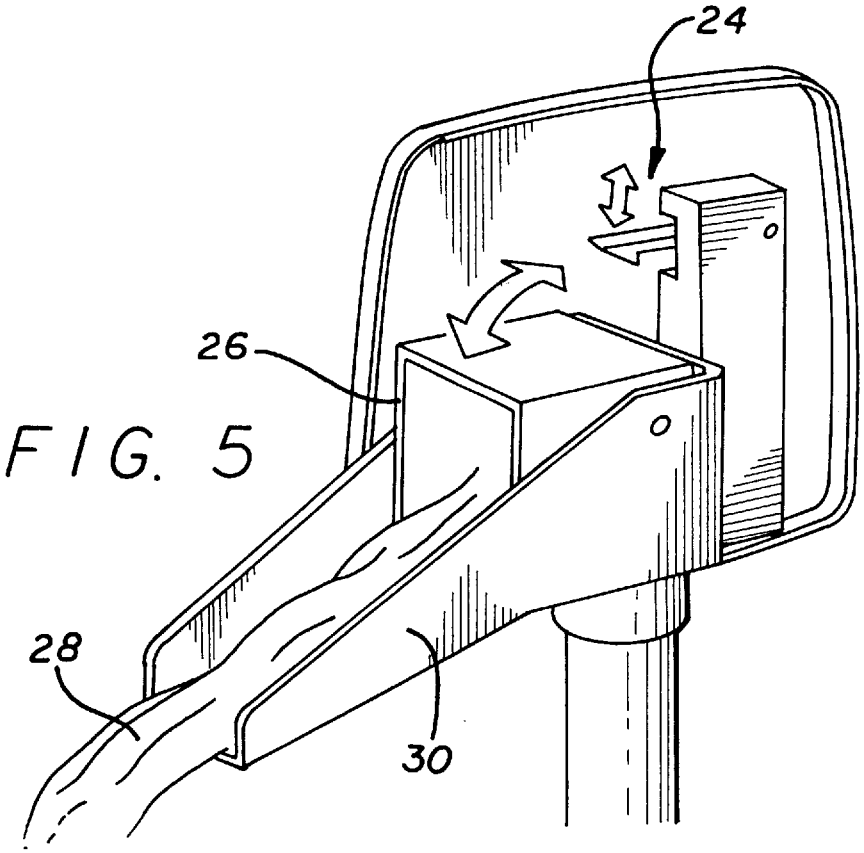
FIG. 5 is a rear perspective view showing the toy releasing a fluid.

The container 26 may be pivotally connected to a chute 30 that is attached to the backboard 14. The center of gravity of the fluid filled container is offset from the pivot point so that the container 26 rotates and releases the fluid when the release mechanism 24 is disengaged as shown in FIGS. 4 and 5.

Referring to FIG. 3, the release mechanism 24 may include a latch 32 that is pivotally attached to the backboard 14. The toy 10 may also have a ratchet 34 that can move and disengage the latch 32 from the container 26. The ratchet 34 has a plurality of notches 36 that engage a detent 38 and a pawl 40. The pawl 40 is pivotally connected to a linkage rod 42. The linkage rod 42 is attached to a trigger 44. The arm 44 extends from the backboard 14 adjacent to the hoop 12 as shown in FIG. 2.

Throwing the ball 20 through the hoop 12 rotates the lever arm 44 and moves the pawl 40 in an upward direction. Movement of the pawl 40 moves the ratchet 34 in an upward direction. When the ball 20 passes the trigger 44 the pawl 40 moves back in a downward direction under the force of gravity. Alternatively, the trigger 44 and rod 42 may have a torsion spring which biases the pawl 40 back to the original position. The detent 38 maintains the new upward position of the ratchet 34 even when the pawl 40 moves down to the original position.

The pawl 40 sequentially moves the ratchet 38 after each made basket until a cam plate 46 of the ratchet 34 engages and pushes the latch 32 out of engagement with the container 26. When disengaged from the latch 32 the offset fluid filled container 26 rotates so that the fluid 28 flows down the chute 30. The ratchet 34 can be manually moved back down to a reset position by a player. The backboard 14 may have a stop 48 that limits the travel of the ratchet 34 in the downward direction. Additionally, the backboard 14 may have a pair of channel plates 50 that guide the ratchet 34.

In operation, as shown in FIG. 1, one of the players is positioned adjacent to the end of the chute 30. Another player throws the ball 20 through the basketball hoop 12. The lever arm 44 is rotated and the ratchet 34 is moved in an upward direction one notch 36 each time the player successfully makes a basket. This process continues until the ratchet 34 disengages the latch 32 and the fluid flows down the chute 30 and onto the player. The ratchet 34 can be reset to any one of the notches 36 so that the player does not know how many baskets will release the water, thereby providing an element of suspense and surprise to the game. By way of example, the ratchet 34 can be set so that one made basket releases the fluid from the container 26. The ratchet 34 functions as a mechanical counter which releases the water after counting a predetermined number of made baskets. The basketball hoop 12 provides a target.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, the toy 10 may include a programmable electrical counter (not shown) that is coupled to the release mechanism by an actuator. The counter may also be coupled to a pressure transducer that senses when the projectile is successfully thrown at a target. The counter counts the number of times that the projectile is successfully thrown at the target. When the counter reaches a predetermined level the actuator is energized to disengage the release mechanism from the container and release the fluid.

What is claimed is:

1. A toy, comprising:

a pole;

a backboard attached to said pole;

a basketball hoop attached to said backboard;

a ball that is projected through said basketball hoop;

a container that contains a fluid;

a latch that engages said container, said latch moves between an engaged position and a disengaged position, wherein said container releases the fluid when said latch is in the disengaged position;

a ratchet that is moved to a released position to move said latch to the disengaged position; and, a trigger that is located adjacent to said basketball hoop and is actuated to move said ratchet to the released position when said ball is projected through said basketball hoop and engages said trigger.

2. The toy as recited in claim 1, further comprising a chute that is attached to said backboard, said container being pivotally attached to said chute.

3. The toy as recited in claim 1, wherein said trigger includes a lever arm and a pawl that moves said ratchet when said ball engages said lever arm.

* * * * *